US006209991B1

(12) United States Patent
Regan et al.

(10) Patent No.: US 6,209,991 B1
(45) **Date of Patent: *Apr. 3, 2001**

(54) TRANSITION METAL CARBIDE FILMS FOR APPLICATIONS IN INK JET PRINTHEADS

(75) Inventors: Michael J Regan, Corvallis, OR (US); Brian J Keefe, La Jolla, CA (US); Ali Emamjomeh, San Diego, CA (US); Roger J Kolodziej; Ulrich E Hess, both of Corvallis, OR (US); John P Whitlock, Lebanon, OR (US); Domingo A Figueredo, Livermore, CA (US); Gregory T Hindman, Albany, OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/811,403

(22) Filed: Mar. 4, 1997

(51) Int. Cl.[7] ..... B41J 2/05
(52) U.S. Cl. ..... 347/63
(58) Field of Search ..... 347/63, 59

(56) References Cited

U.S. PATENT DOCUMENTS

| | | | | |
|---|---|---|---|---|
| 4,596,994 | | 6/1986 | Matsuda | 346/140 R |
| 4,719,477 | | 1/1988 | Hess | 346/140 R |
| 5,278,584 | | 1/1994 | Keefe | 346/140 R |
| 5,317,346 | | 5/1994 | Garcia | 346/140 R |
| 5,469,199 | | 11/1995 | Allen | 347/42 |
| 5,635,968 | * | 6/1997 | Bhaaskar et al. | 347/59 |
| 5,710,070 | * | 1/1998 | Chan | 438/21 |
| 5,811,851 | * | 9/1998 | Nishioka et al. | 257/62 |

FOREIGN PATENT DOCUMENTS

| | | | |
|---|---|---|---|
| 0317171 | 5/1989 | (EP) | B41J/3/04 |
| 0475235 | 3/1992 | (EP) | B41J/2/205 |
| 0490668 | 6/1992 | (EP) | B41J/2/16 |
| 0593133 | 4/1994 | (EP) | B41J/2/16 |

OTHER PUBLICATIONS

Author: J.S. Aden et al. Publication: Hewlett–Packard Journal, vol. 45, No. 1 Title: The Third–Generation HP Thermal Inkjet Printhead Date: Feb. 1, 1994 pp. 41–45.

Copy of EPO Search Report, dated Jun. 15, 1998, from application EP 97 12 0951.

Copy of EPO Search Report, dated Jun. 15, 1998, from application EP 97 12 0952.

"Development Of The Thin–Film Structure For The Think-Jet Printhead," Bhasakr & Aden, Hewlett–Packard Journal, vol. 36, No. 5, May 1985, pp. 27–33.

"Development Of A High–Resolution Thermal Inkjet Printhead," Buskirk, Hackleman, Hall, Kanarek, Low, Trueba, Van de Poll, Hewlett–Packard Journal, vol. 39, No. 5, Oct. 1988, pp. 55–61.

"The Third–Generation HP Thermal InkJet Printhead," Aden, Bohorquez, Collins, Crook, Garcia & Hess, Hewlett–Packard Journal, vol. 45, No. 1, Feb. 1994, pp. 41–45.

* cited by examiner

*Primary Examiner*—John Barlow
*Assistant Examiner*—Michael S. Brooke
(74) *Attorney, Agent, or Firm*—Manuel Quiogue

(57) ABSTRACT

A thermal ink jet printhead that includes a thin film substrate including a plurality of thin film layers, a plurality of ink firing heater resistors defined in the plurality of thin film layers, a patterned tantalum carbide layer disposed on the plurality of thin film layers, an ink barrier layer disposed over the tantalum carbide layer, and respective ink chambers formed in the ink barrier layer over respective thin film resistors, each chamber formed by a chamber opening in barrier layer. The tantalum carbide layer forms an oxidation and wear resistance layer and/or a barrier adhesion layer.

24 Claims, 5 Drawing Sheets

TRANSITION METAL CARBIDE FILMS FOR APPLICATIONS IN INK JET PRINTHEADS

This application relates to the subject matter disclosed in commonly assigned copending U.S. application Ser. No. 08/811,404, filed herewith on Mar. 04, 1997, entitled "STRUCTURE TO EFFECT ADHESION BETWEEN SUBSTRATE AND INK BARRIER IN AN INK JET PRINTHEAD", which is incorporated herein by reference.

BACKGROUND OF THE INVENTION

The subject invention generally relates to ink jet printing, and more particularly to thin film ink jet printheads for ink jet cartridges and methods for manufacturing such printheads.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent to the ink chambers.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The thin film substructure more particularly includes a top thin film layer of tantalum disposed over the resistors as a thermomechanical passivation layer.

The ink barrier layer is typically a polymer material that is laminated as a dry film to the thin film substructure, and is designed to be photodefinable and both UV and thermally curable. layer forms an oxidation and wear resistance layer and/or a barrier adhesion layer.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
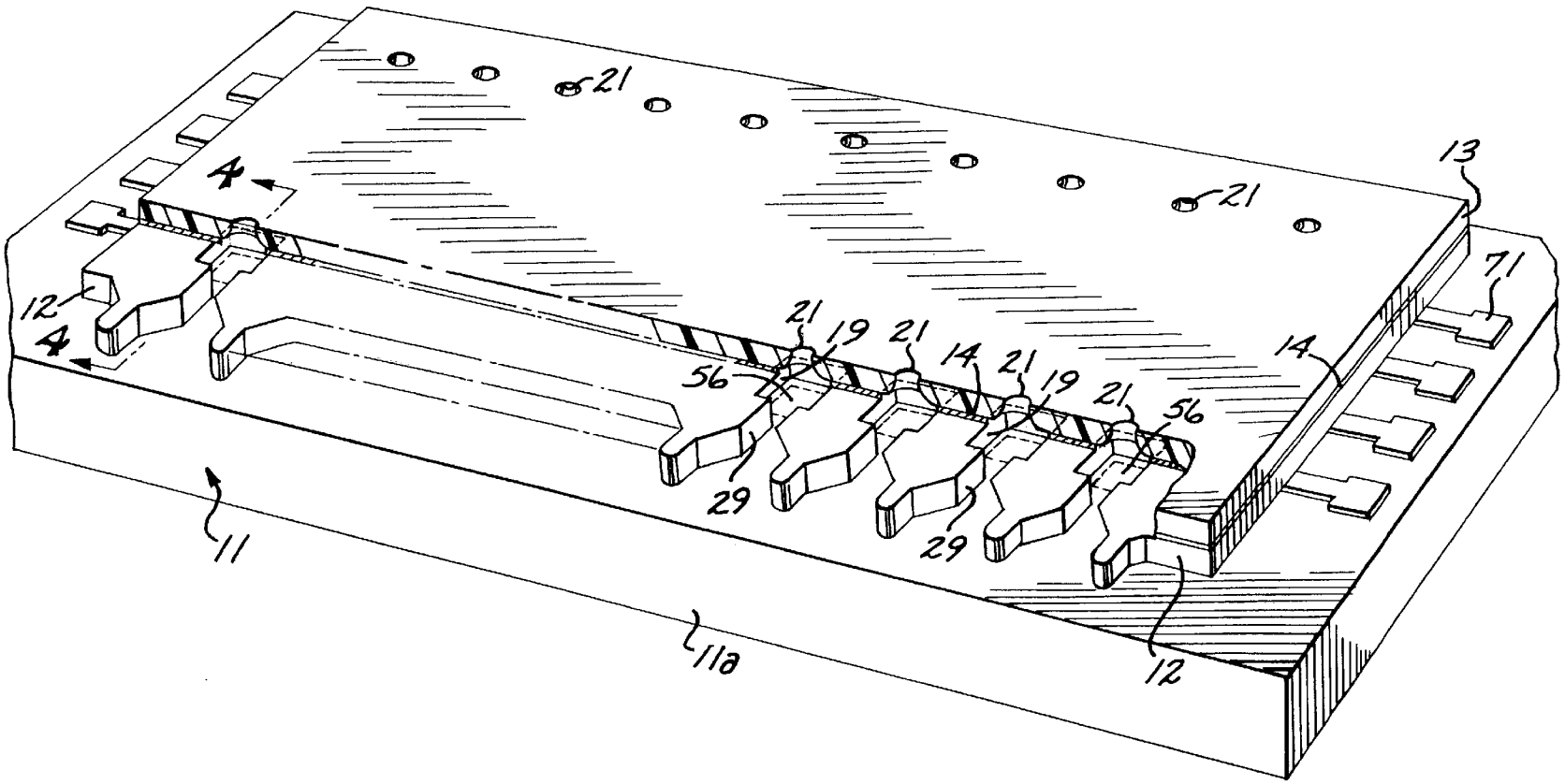
FIG. 1 is a schematic, partially sectioned perspective view of an ink jet printhead in accordance with the invention.

The problem with tantalum as a bonding surface is due to the fact that while the tantalum layer is pure tantalum when it is first formed in a sputtering apparatus, a tantalum oxide layer forms as soon as the tantalum layer is exposed to an oxygen containing atmosphere. The chemical bond between an oxide and a polymer film tends to be easily degraded by water, since the water forms a hydrogen bond with the oxide that competes with and replaces the original polymer to oxide bond, and thus ink formulations, particularly the more aggressive ones, debond an interface between a metal oxide and a polymer barrier.

SUMMARY OF THE INVENTION

It would therefore be an advantage to provide an ink jet printhead having a thermomechanical passivation layer with increased wear resistance.

It would therefore be an advantage to provide an improved ink jet printhead that reduces delamination of the interface between the thin film substructure and the ink barrier layer.

A further advantage would be to provide in a ink jet printhead a bonding surface that provides bonding sites to which a polymer barrier layer can form a stable chemical bond.

The foregoing and other advantages are provided by the invention in an ink jet printhead that includes a thin film substrate including a plurality of thin film layers, a plurality of ink firing heater resistors defined in the plurality of thin film layers, a patterned tantalum carbide layer disposed on the plurality of thin film layers, an ink barrier layer disposed over the tantalum carbide layer, and respective ink chambers formed in the ink barrier layer over respective thin film resistors, each chamber formed by a chamber opening in barrier layer. The tantalum carbide An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. No. 4,719,477 and U.S. Pat. No. 5,317,346, both of which are incorporated herein by reference.

A consideration with the foregoing ink jet printhead architecture includes reduced heater resistor life due to accelerated oxidation of localized regions of the tantalum passivation layer.

Another consideration with the foregoing ink jet printhead architecture include delamination of the ink barrier layer from the thin film substructure. Delamination principally occurs from environmental moisture and the ink itself which is in continual contact with the edges of the thin film substructure/barrier interface in the drop generator regions.

It has been determined that the tantalum thermomechanical passivation layer offers the additional functionality of improving adhesion to the ink barrier layer. However, while the barrier adhesion to tantalum has proven to be sufficient for printheads that are incorporated into disposable ink jet cartridges, barrier adhesion to tantalum is not sufficiently robust for semipermanent ink jet printheads which are not replaced as frequently. Moreover, new developments in ink chemistry have resulted in formulations that more aggressively debond the interface between the thin film substructure and the barrier layer, as well as the interface between the barrier layer and the orifice plate.

In particular, water from the ink enters the thin film substructure/barrier interface by penetration through the bulk of the barrier and penetration along the thin film substructure/barrier interface, causing debonding of the interfaces through a chemical mechanism such as hydrolysis.

In the following detailed description and in the several figures of the drawing, like elements are identified with like reference numerals.

Referring now to FIG. 1, set forth therein is an unscaled schematic perspective view of an ink jet printhead in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 attached to the top of the ink barrier 12 with a silicon carbide adhesion layer 14.

The thin film substructure 11 is formed pursuant to integrated circuit fabrication techniques, and includes thin film heater resistors 56 formed therein. By way of illustrative example, the thin film heater resistors 56 are located in rows along longitudinal edges of the thin film substructure.

The ink barrier layer 12 is formed of a dry film that is heat and pressure laminated to the thin film substructure 11 and photodefined to form therein ink chambers 19 and ink channels 29 which are disposed over resistor regions which are on either side of a generally centrally located gold layer 62 (FIG. 2) on the thin film substructure 11. Gold bonding pads 71 engagable for external electrical connections are disposed at the ends of the thin film substructure 11 and are not covered by the ink barrier layer 12. As discussed further herein with respect to FIG. 2, the thin film substructure 11 includes a patterned gold layer 62 generally disposed in the middle of the thin film substructure 11 between the rows of heater resistors 56, and the ink barrier layer 12 covers most of such patterned gold layer 62, as well as the areas between adjacent heater resistors 56. By way of illustrative example, the barrier layer material comprises an acrylate based photopolymer dry film such as the Parad brand photopolymer dry film obtainable from E. I. duPont de Nemours and Company of Wilmington, Del. Similar dry films include other duPont products such as the Riston brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise, by way of further example, a plated metal such as nickel.

Figure 1A:
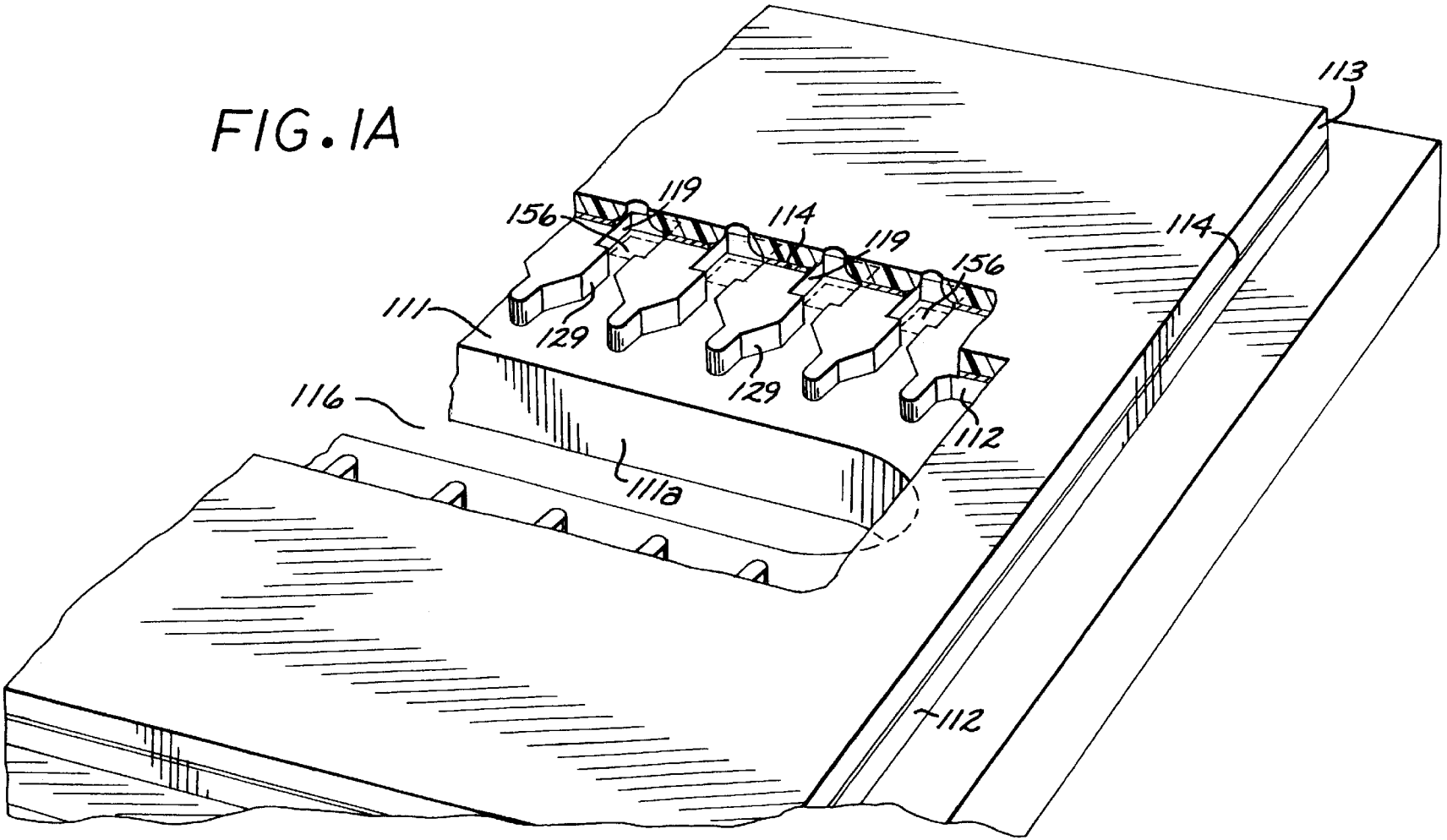
FIG. 1A is a schematic, partially sectioned perspective view of a further ink jet printhead in accordance with the invention.

The ink chambers 19 in the ink barrier layer 12 are more particularly disposed over respective ink firing resistors 56, and each ink chamber 19 is defined by the edge or wall of a chamber opening formed in the barrier layer 12. The ink channels 29 are defined by further openings formed in the barrier layer 12, and are integrally joined to respective ink firing chambers 19. By way of illustrative example, FIG. 1 illustrates an outer edge fed configuration wherein the ink channels 29 open towards an adjacent outer longitudinal edge 11*a* of the outer perimeter of the thin film substructure 11 and ink is supplied to the ink channels 29 and the ink chambers 19 around the outer longitudinal edges of the thin film substructure, for example as more particularly disclosed in commonly assigned U.S. Pat. No. 5,278,584, incorporated herein by reference, whereby the outer longitudinal edges 11*a* comprise feed edges. The invention can also be employed in a center edge fed ink jet printhead such as that disclosed in previously identified U.S. Pat. No. 5,317,346, and as schematically illustrated in FIG. 1A wherein ink channels 129 open towards an edge 111*a* formed by a slot 116 in the middle of the thin film substructure 111 in which heater resistors 156 are formed, whereby such edge comprises a feed edge. Similarly to the printhead of FIG. 1, the printhead of FIG. 1A includes an ink barrier layer 112, ink chambers 119, and an orifice plate 113 attached to the top of the ink barrier 112 with a silicon carbide adhesion layer 114.

The orifice plate 13 includes orifices 21 disposed over respective ink chambers 19, such that an ink firing resistor 56, an associated ink chamber 19, and an associated orifice 21 are aligned. An ink drop generator region is formed by each ink chamber 19 and portions of the thin film substructure 11 and the orifice plate 13 that are adjacent the ink chamber 19.

Figure 2:
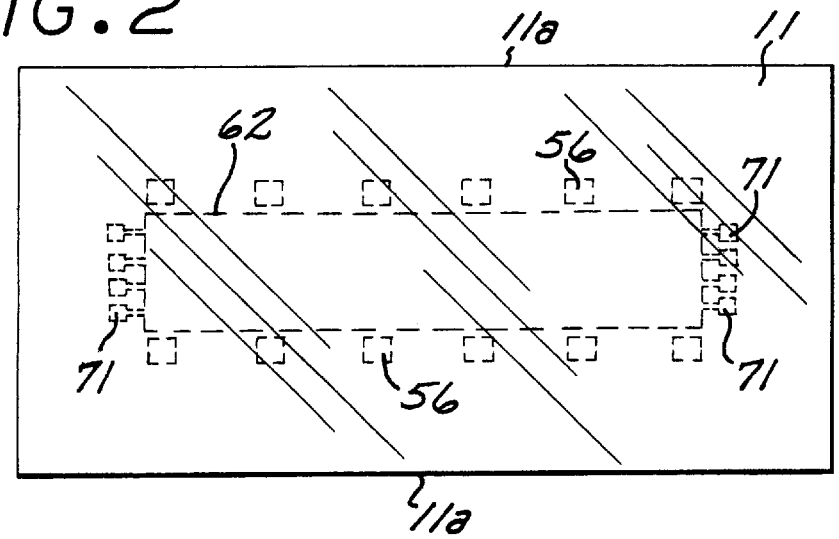
FIG. 2 is an unscaled schematic top plan illustration of the general layout of the thin film substructure of the ink jet printhead of FIG. 1.

Referring now to FIG. 2, set forth therein is an unscaled schematic top plan illustration of the general layout of the thin film substructure 11. The ink firing resistors 56 are formed in resistor regions that are adjacent the outer longitudinal edges 11*a* the thin film substructure 11. A patterned gold layer 62 comprised of gold traces forms the top layer of the thin film structure in a gold layer region located generally in the middle of the thin film substructure 11 between the resistor regions and extending between the ends of the thin film substructure 11. Bonding pads 71 for external connections are formed in the patterned gold layer 62, for example adjacent the ends of the thin film substructure 11. The ink barrier layer 12 is defined so as to cover all of the patterned gold layer 62 except for the bonding pads 71, and also to cover the areas between the respective openings that form the ink chambers and associated ink channels. Depending upon implementation, one or more thin film layers can be disposed over the patterned gold layer 62.

Figure 3:
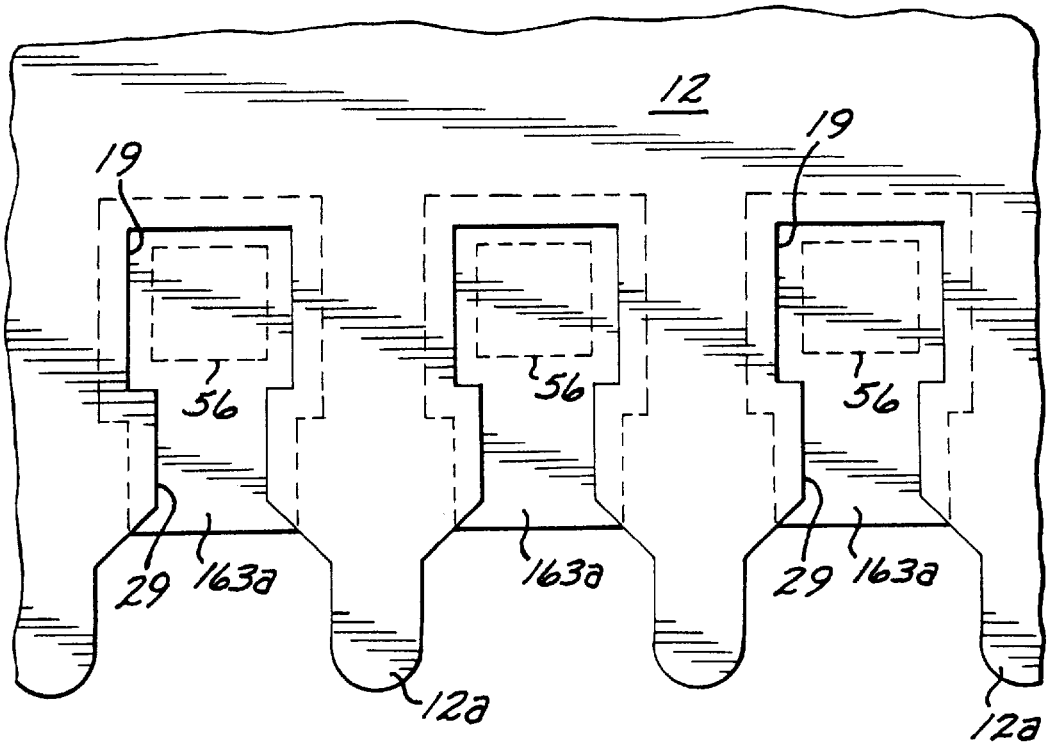
FIG. 3 is an unscaled schematic top plan view illustrating the configuration of a plurality of representative heater resistors, ink chambers and associated ink channels.
Figure 4:
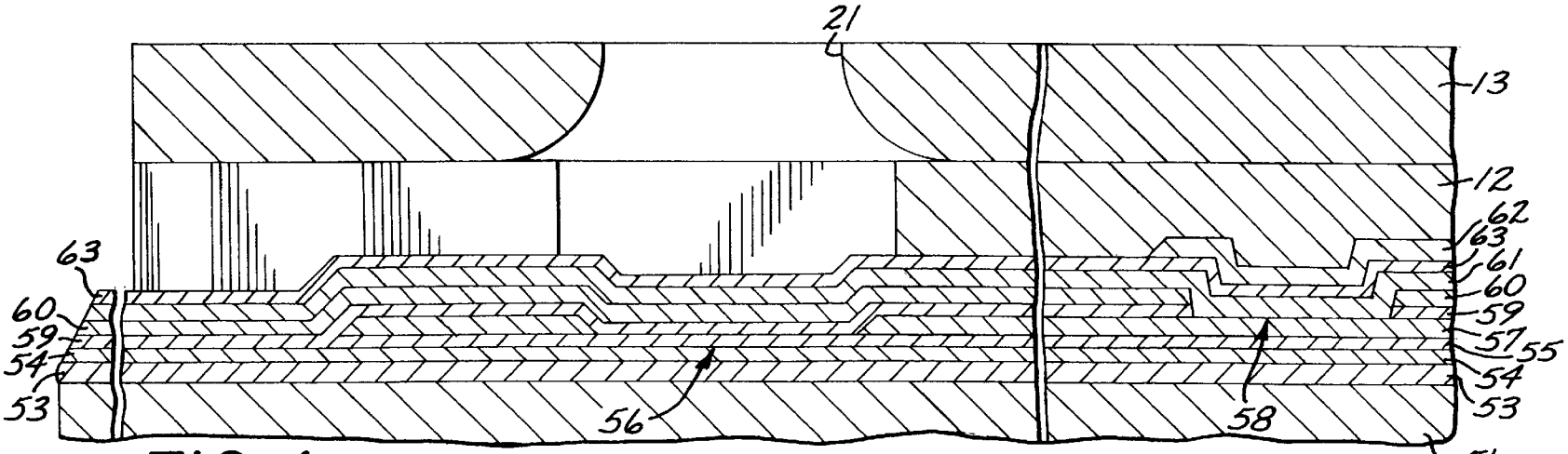
FIG. 4 is an unscaled schematic cross sectional view of the ink jet printhead of FIG. 1 taken laterally through a representative ink drop generator region and illustrating an embodiment of the printhead of FIG. 1.

Referring now to FIG. 3, set forth therein is an unscaled schematic top plan view illustrating the configuration of a plurality of representative heater resistors 56, ink chambers 19 and associated ink channels 29. As shown in FIG. 4, the heater resistors 56 are polygon shaped (e.g., rectangular) and are enclosed on at least two sides thereof by the wall of an ink chamber 19 which for example can be multi-sided. The ink channels 29 extend away from associated ink chambers 19 and can become wider at some distance from the ink chambers 19. Insofar as adjacent ink channels 29 generally extend in the same direction, the portions of the ink barrier layer 12 that form the openings that define ink chambers 19 and ink channels 29 thus form an array of barrier tips 12*a* that extend toward an adjacent feed edge of the thin film substructure 11 from a central portion of the barrier layer 12 that covers the patterned gold layer 62 and is on the side of the heater resistors 56 away from the adjacent feed edge. Stated another way, ink chambers 19 and associated ink channels 29 are formed by an array of side by side barrier tips 12*a* that extend from a central portion of the ink barrier 12 toward a feed edge of the thin film substructure 11.

In accordance with the invention, the thin film substructure 11 includes a patterned tantalum carbide layer 63 (FIGS. 4, 5, 6) that functions as a wear resistant layer over the heater resistors and/or an adhesion layer for the ink barrier layer 12. As described further herein, the tantalum carbide layer can comprise (a) a blanket film that covers most of the thin film substructure (illustrated in FIG. 4), (b) subareas that are located beneath respective ink chambers (illustrated in FIG. 5), or (c) a generally blanket film that includes openings over the heater resistors so as to be absent from the heater resistor areas.

Referring now to FIG. 4, set forth therein is an unscaled schematic cross sectional view of the ink jet printhead of FIG. 1 taken through a representative ink drop generator region and a portion of the centrally located gold layer region, and illustrating a specific embodiment of the thin film substructure 11. The thin film substructure 11 of the ink jet printhead of FIG. 4 more particularly includes a silicon substrate 51, a field oxide layer 53 disposed over the silicon substrate 51, and a patterned phosphorous doped oxide layer 54 disposed over the field oxide layer 53. A resistive layer 55 comprising tantalum aluminum is formed on the phosphorous oxide layer 54, and extends over areas where thin film resistors, including ink firing resistors 56, are to be formed beneath ink chambers 19. A patterned metallization layer 57 comprising aluminum doped with a small percentage of copper and/or silicon, for example, is disposed over the resistor layer 55.

The metallization layer 57 comprises metallization traces defined by appropriate masking and etching. The masking and etch of the metallization layer 57 also defines the resistor areas. In particular, the resistive layer 55 and the metallization layer 57 are generally in registration with each other, except that portions of traces of the metallization layer 57 are removed in those areas where resistors are formed. In this manner, the conductive path at an opening in a trace in the metallization layer includes a portion of the resistive layer 55 located at the opening or gap in the conductive trace. Stated another way, a resistor area is defined by providing first and second metallic traces that terminate at different locations on the perimeter of the resistor area. The first and second traces comprise the terminal or leads of the resistor which effectively include a portion of the resistive layer that is between the terminations of the first and second traces. Pursuant to this technique of forming resistors, the resistive layer 55 and the metallization layer can be simultaneously etched to form patterned layers in registration with each other. Then, openings are etched in the metallization layer 57 to define resistors. The ink firing resistors 56 are thus particularly formed in the resistive layer 55 pursuant to gaps in traces in the metallization layer 57.

A composite passivation layer comprising a layer 59 of silicon nitride ($Si_3N_4$) and a layer 60 of silicon carbide (SiC) is disposed over the metallization layer 57, the exposed portions of the resistive layer 55, and exposed portions of the oxide layer 53. A tantalum passivation layer 61 is disposed on the composite passivation layer 59, 60 over most of the thin film substructure 11 so as to be disposed over the heater resistors 56 and extending beyond the ink chambers 19. The tantalum passivation layer 61 can also extend to areas over which the patterned gold layer 62 is formed for external electrical connections to the metallization layer 57 by conductive vias 58 formed in the composite passivation layer 59, 60. A tantalum carbide layer 63 is disposed on the tantalum layer 61 and functions as wear layer in the ink chambers 19 and as an adhesion layer in areas where it is in contact with the barrier layer 12. Thus, to the extent that tantalum carbide to barrier adhesion in desired in the vicinity of the ink chambers and ink channels, the interface between the tantalum carbide layer 63 and the barrier 12 can extend for example from at least the region between the resistors 56 and the patterned gold layer 62 to the ends of the barrier tips 12*a*. To the extent that the increased resistivity of tantalum carbide in the vias is not suitable, the tantalum carbide can be etched from the vias.

Figure 5:
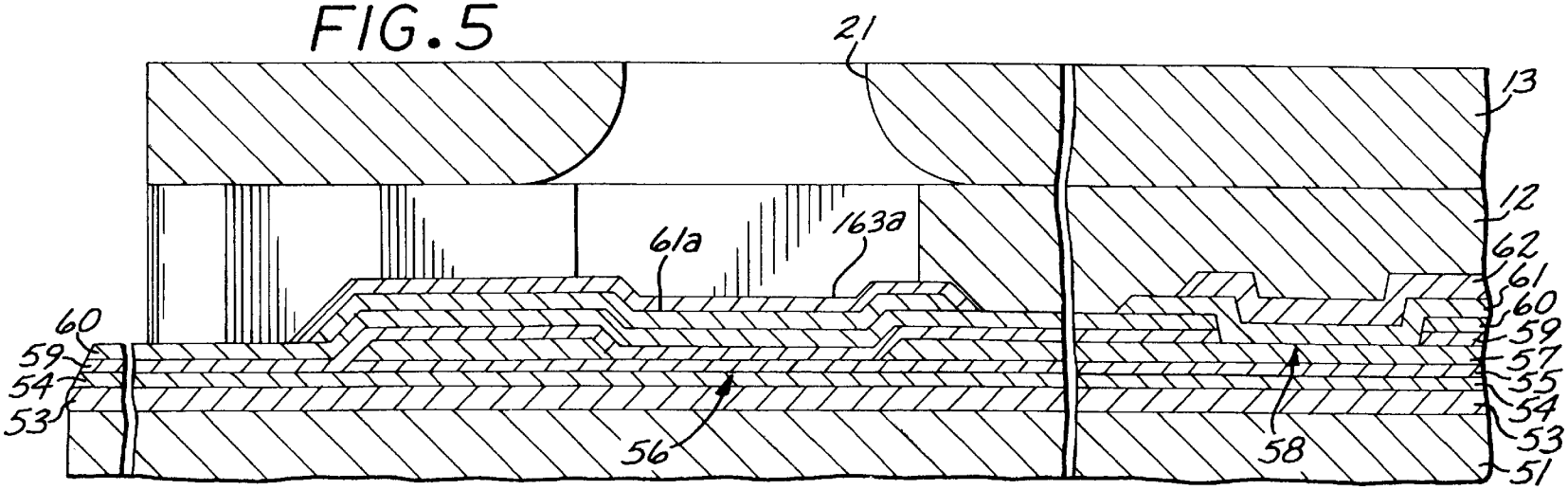
FIG. 5 sets forth an unscaled schematic cross sectional view of the ink jet printhead of FIG. 1 taken laterally through a representative ink drop generator region and illustrating another embodiment of the printhead of FIG. 1.

Referring now to FIG. 5, set forth therein is an unscaled schematic cross sectional view of the ink jet printhead of FIG. 1 taken laterally through a representative ink drop generator region and a portion of the patterned gold layer 62, and illustrating another specific embodiment of the an ink jet printhead in accordance with the invention. The ink jet printhead of FIG. 5 is similar to the ink jet printhead of FIG. 4, except that a tantalum carbide layer 163 is limited to tantalum subareas 163*a* that are beneath ink chambers 19 and portions of associated ink channels 29 adjacent the ink chambers 19. As shown in plan view in FIG. 3, the subareas 163*a* extend beyond the ink chamber 19 and the ink channels 29, and in this manner, the tantalum carbide subareas 163*a* function as an oxidation and wear resistance layer in the ink chambers 19, and as a barrier adhesion layer in the vicinity of the ink chambers 19 and the ink channels 29. As a minimum, the tantalum carbide subareas 63*a* extend into areas that are subject to bubble collapse to provide mechanical passivation for the ink firing resistors by absorbing the cavitation pressure of the collapsing drive bubble.

Figure 6:
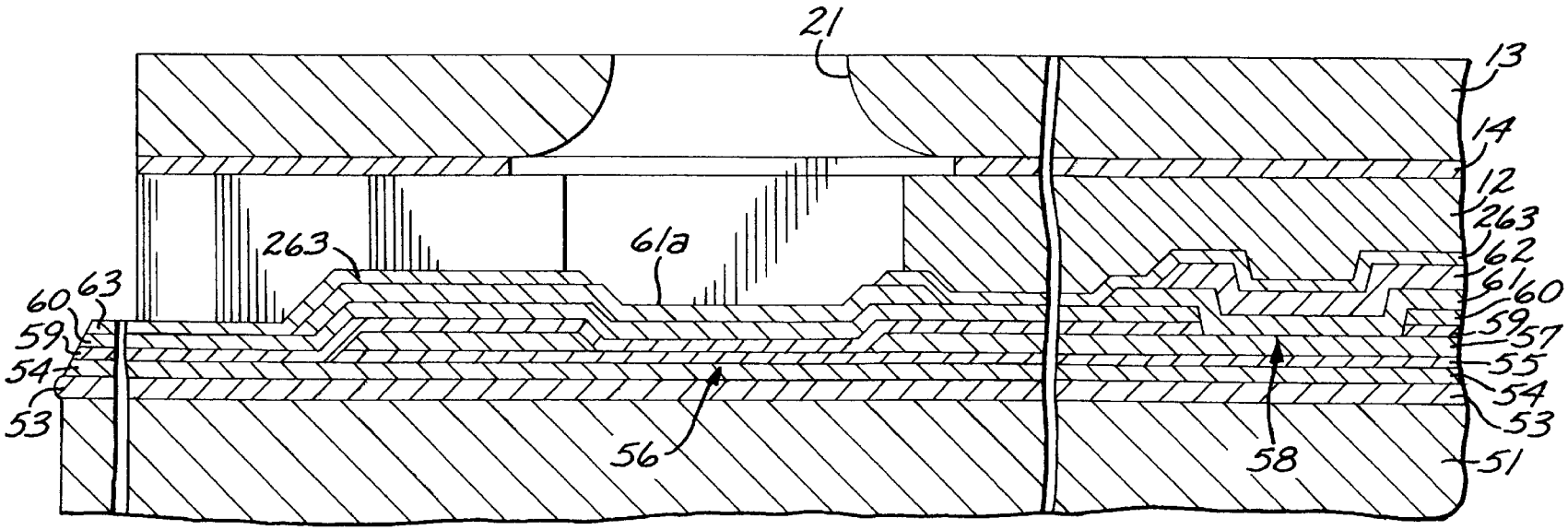
FIG. 6 is an unscaled schematic cross sectional view of the ink jet printhead of FIG. 1 taken laterally through a representative ink drop generator region and illustrating a further embodiment of the printhead of FIG. 1.

Referring now to FIG. 6, set forth therein is an unscaled schematic cross sectional view of the ink jet printhead of FIG. 1 taken laterally through a representative ink drop generator region and a portion of the patterned gold layer 62, and illustrating another specific embodiment of the an ink jet printhead in accordance with the invention. The ink jet printhead of FIG. 6 is similar to the ink jet printhead of FIG. 4, with the modification that a tantalum carbide layer 263 comprises a blanket barrier adhesion layer that covers most of the thin film substructure except areas over the heater resistors 56. In other words, the tantalum carbide layer 263 includes openings over the heater resistors 56.

The foregoing printhead is readily produced pursuant to standard thin film integrated circuit processing including chemical vapor deposition, photoresist deposition, masking, developing, and etching, for example as disclosed in commonly assigned U.S. Pat. No. 4,719,477 and U.S. Pat. No. 5,317,346, both previously incorporated herein by reference.

By way of illustrative example, the foregoing structures can be made as follows. Starting with the silicon substrate 51, any active regions where transistors are to be formed are protected by patterned oxide and nitride layers. Field oxide 53 is grown in the unprotected areas, and the oxide and nitride layers are removed. Next, gate oxide is grown in the active regions, and a polysilicon layer is deposited over the entire substrate. The gate oxide and the polysilicon are etched to form polysilicon gates over the active areas. The resulting thin film structure is subjected to phosphorous predeposition by which phosphorous is introduced into the unprotected areas of the silicon substrate. A layer of phosphorous doped oxide 54 is then deposited over the entire in-process thin film structure, and the phosphorous doped oxide coated structure is subjected to a diffusion drive-in step to achieve the desired depth of diffusion in the active areas. The phosphorous doped oxide layer is then masked and etched to open contacts to the active devices.

The tantalum aluminum resistive layer 55 is then deposited, and the aluminum metallization layer 57 is subsequently deposited on the tantalum aluminum layer 55. The aluminum layer 57 and the tantalum aluminum layer 55 are etched together to form the desired conductive pattern. The resulting patterned aluminum layer is then etched to open the resistor areas.

The silicon nitride passivation layer 59 and the SiC passivation layer 60 are respectively deposited. A photoresist pattern which defines vias to be formed in the silicon nitride and silicon carbide layers 59, 60 is disposed on the silicon carbide layer 60, and the thin film structure is subjected to overetching, which opens vias through the composite passivation layer comprised of silicon nitride and silicon carbide to the aluminum metallization layer.

As to the implementation of FIG. 4 wherein the tantalum layer 61 and the tantalum carbide layer 63 are similarly patterned, such layers are formed for example by sputtering. Tantalum targets are sputtered in an inert gas such as argon or krypton to form the tantalum layer. After the desired tantalum thickness is obtained, a hydrocarbon containing gas such as acetylene or methane is mixed with the inert gas which allows the formation of the tantalum carbide layer. By way of illustrative example, the tantalum layer has a thickness of approximately 5000 Angstroms, and the tantalum carbide layer has a thickness of about 1000 Angstroms. The tantalum and tantalum carbide layers are then etched in the same pattern, and the gold layer 62 for external connections is deposited and etched.

As to the implementation of FIG. 5, the tantalum layer 61 and the tantalum carbide layer 63 are formed for example by sputtering as described above. The tantalum carbide layer is then etched to define the tantalum carbide layers, and the exposed tantalum layer is etched to define the tantalum areas.

As to the implementation of FIG. 6, the tantalum layer 61 is formed and etched to define the tantalum areas. The gold layer 62 is then deposited and etched, and the tantalum carbide layer is formed, for example by sputtering, and then etched.

After the thin film substructure 11 is formed, the ink barrier layer 12 is heat and pressure laminated onto the thin film substructure. The silicon carbide layer 14 is formed on the orifice plate 13, and the orifice plate 13 with the silicon carbide layer 14 is laminated onto the laminar structure comprised of the silicon carbide layer 14, the ink barrier layer 12, and the thin film substructure 11.

While the foregoing embodiments include a tantalum passivation layer over the heater resistors, it should be appreciated that a single tantalum carbide layer can replace the tantalum and tantalum carbide layers. The invention further contemplates other transition metal carbide films such as tungsten carbide and titanium carbide.

The foregoing has thus been a disclosure of an ink jet printhead having a transition metal carbide layer as a wear resistance layer and/or a barrier adhesion layer, and which provides a further advantage of improved print quality by functioning as a kogation limiter in the ink chambers.

Although the foregoing has been a description and illustration of specific embodiments of the invention, various modifications and changes thereto can be made by persons skilled in the art without departing from the scope and spirit of the invention as defined by the following claims.

What is claimed is:

1. A thin film ink jet printhead, comprising:

a thin film substrate including a plurality of thin film layers;

a plurality of ink firing heater resistors defined in said plurality of thin film layers;

a patterned transition metal carbide layer disposed on said plurality of thin film layers;

a polymer ink barrier layer disposed over said transition metal carbide layer;

said patterned transition metal carbide layer functioning as an adhesion layer between said thin film substrate and said polymer ink barrier layer;

respective ink chambers formed in said polymer ink barrier layer over respective thin film resistors, each chamber formed by a chamber opening in said polymer ink barrier layer; and an orifice plate disposed over said polymer ink barrier layer.

2. The ink jet printhead of claim 1 wherein said transition metal carbide layer is disposed over said heater resistors and extends beyond said ink chambers to underlie the barrier layer.

3. The ink jet printhead of claim 2 further including a tantalum layer underlying said transition metal carbide layer.

4. The ink jet printhead of claim 2 wherein said thin film substrate includes a feed edge, and wherein:

said thin film resistors are arranged along said feed edge of said substrate;

said ink chambers are formed by barrier tips that extend between resistors toward said feed edge from a region on a side of the resistors opposite said feed edge; and said transition metal carbide layer extends along said barrier tips from said region on a side of the resistors opposite said feed edge.

5. The ink jet printhead of claim 4 wherein said feed edge comprises an outer edge of said substrate.

6. The ink jet printhead of claim 4 wherein said feed edge is formed by a slot in the middle of said substrate.

7. The ink jet printhead of claim 1 wherein said transition metal carbide layer includes openings over said heater resistors.

8. The ink jet printhead of claim 7 wherein said thin film substrate includes a feed edge, and wherein:

said thin film resistors are arranged along said feed edge of said substrate;

said ink chambers are formed by barrier tips that extend between resistors toward said feed edge from a region on a side of the resistors opposite said feed edge; and said transition metal carbide layer extends along said barrier tips from said region on a side of the resistors opposite said feed edge.

9. The ink jet printhead of claim 8 wherein said feed edge comprises an outer edge of said substrate.

10. The ink jet printhead of claim 8 wherein said feed edge is formed by a slot in the middle of said substrate.

11. The ink jet printhead of claim 1 wherein said transition metal carbide layer comprises a tantalum carbide layer.

12. A thin film ink jet printhead, comprising:

a thin film substrate including a plurality of thin film layers;

a plurality of ink firing heater resistors defined in said plurality of thin film layers;

said plurality of thin film layers including a passivation layer structure defined over at least one of said plurality of ink firing resistors, said passivation layer structure including a layer of silicon carbide;

a transition metal carbide layer disposed on said plurality of thin film layers disposed over said passivation layer structure;

a polymer ink barrier layer disposed over said transition metal carbide layer;

respective ink chambers formed in said ink barrier layer over respective thin film resistors, each chamber formed by a chamber opening in said barrier layer; and an orifice plate disposed over said ink barrier layer.

13. The printhead of claim 12 wherein the passivation layer structure further includes a layer of silicon nitride underlying said layer of silicon carbide.

14. The printhead of claim 12 wherein said transition metal carbide layer is disposed at least over said ink firing heater resistors.

15. The printhead of claim 12 further comprising a tantalum passivation layer disposed on said passivation layer structure so as to be disposed at least over said ink firing heater resistors.

16. The printhead of claim 15 wherein said transition metal carbide layer and said tantalum passivation layer further extends beyond the ink chambers to underlie the barrier layer.

17. The printhead of claim 16 wherein said thin film substrate includes a feed edge, and wherein:

said thin film resistors are arranged along said feed edge of said substrate;

said ink chambers are formed by barrier tips that extend between resistors toward said feed edge from a region on a side of the resistors opposite said feed edge; and said transition metal carbide layer extends along said barrier tips from said region on a side of the resistors opposite said feed edge.

18. The printhead of claim 17 wherein said feed edge comprises an outer edge of said substrate.

19. The printhead of claim 17 wherein said feed edge is formed by a slot in a middle of said substrate.

20. The printhead of claim 12 wherein said transition metal carbide layer includes openings over said ink firing heater resistors.

21. The printhead of claim 20 wherein said thin film substrate includes a feed edge, and wherein:

said thin film resistors are arranged along said feed edge of said substrate;

said ink chambers are formed by barrier tips that extend between resistors toward said feed edge from a region on a side of the resistors opposite said feed edge; and said transition metal carbide layer extends along said barrier tips from said region on a side of the resistors opposite said feed edge.

22. The printhead of claim 21 wherein said feed edge comprises an outer edge of said substrate.

23. The printhead of claim 21 wherein said feed edge is formed by a slot in a middle of said substrate.

24. The printhead of claim 12 wherein said transition metal carbide layer comprises a tantalum carbide layer.

* * * * *